US005996497A

United States Patent [19]

DeBoer et al.

[11] Patent Number: 5,996,497

[45] Date of Patent: Dec. 7, 1999

[54] METHOD OF MAKING A DURABLE HYDROPHILIC LAYER

[75] Inventors: Charles D. DeBoer, Palmyra; Werner N. Fassler, Rochester; Lee W. Tutt, Webster, all of N.Y.

[73] Assignee: Eastman Kodak Company, Rochester, N.Y.

[21] Appl. No.: 09/096,633

[22] Filed: Jun. 12, 1998

[51] Int. Cl.[6] ..... B41N 3/00; B05D 3/02

[52] U.S. Cl. ..... 101/463.1; 101/455; 427/190; 427/193

[58] Field of Search ..... 101/455, 458, 101/459, 463.1, 466, 467; 427/189, 190, 191, 193, 203, 204; 347/105, 106

[56] References Cited

U.S. PATENT DOCUMENTS

| | | | |
|---|---|---|---|
| 3,773,549 | 11/1973 | Elbert et al. | 117/129 |
| 3,922,441 | 11/1975 | Shaw | 101/462 |
| 4,054,467 | 10/1977 | Mikelsons | 427/203 |
| 4,445,998 | 5/1984 | Kanda et al. | 101/463.1 |
| 4,743,530 | 5/1988 | Farid et al. | 430/281 |
| 5,080,292 | 1/1992 | Nishibori | 241/21 |
| 5,147,921 | 9/1992 | Mallo | 524/493 |
| 5,204,219 | 4/1993 | Van Ooij et al. | 430/272 |
| 5,345,869 | 9/1994 | Treverton et al. | 101/454 |
| 5,738,013 | 4/1998 | Kellett | 101/467 |

OTHER PUBLICATIONS

Chemical Reviews, 1989, vol. 89, No. 4, p. 766.

*Primary Examiner*—Stephen R. Funk
*Attorney, Agent, or Firm*—Raymond L. Owens

[57] ABSTRACT

A method of making a porous, hydrophilic layer with a high surface energy on a substrate for a printing plate, ink jet receiver or the like by the steps of grinding an inorganic gel containing a liquid to provide a fine coatable dispersion of inorganic gel, coating the dispersion of inorganic gel onto the substrate, and heating the dispersion coating to provide the porous hydrophilic layer.

6 Claims, 3 Drawing Sheets

METHOD OF MAKING A DURABLE HYDROPHILIC LAYER

CROSS REFERENCE TO RELATED APPLICATIONS

Reference is made to commonly assigned U.S. patent application Ser. No. 09/067,247 filed Apr. 27, 1998 entitled "Imaging and Printing Methods to Form Imaging Member by Formation of Insoluble Crosslinked Polymeric Sol-Gel Matrix" in the name of Charles D. DeBoer et al. The disclosure of this related application is incorporated herein by reference.

FIELD OF THE INVENTION

This invention relates to the preparation of thin, durable, porous, hydrophilic layers for use in applications such as lithographic printing plates.

BACKGROUND OF THE INVENTION

The art of lithographic printing relies on the immiscibility of oil and water, wherein the oily material or ink is preferentially retained by the image area of a lithographic printing plate. When a suitably prepared surface is moistened with water and an ink is then applied, the background or non-image area retains the water and repels the ink while the image area accepts the ink and repels the water. The ink on the image area is then transferred to the surface of a material upon which the image is to be reproduced; such as paper, cloth and the like. Commonly the ink is transferred to an intermediate material called the blanket which in turn transfers the ink to the surface of the material upon which the image is to reproduced.

A commonly used type of lithographic printing plate has a light-sensitive coating applied to an aluminum base support. The coating may respond to light by having the portion which is exposed become soluble so that it is removed in the developing process. Such a plate is referred to as positive-working. Conversely, when that portion of the coating which is exposed becomes hardened, the plate is referred to as negative-working. In both instances the image area remaining is ink-receptive or oleophilic and the non-image area or background is water-receptive or hydrophilic. The differentiation between image and non-image areas is made in the exposure process where a film is applied to the plate with a vacuum to insure good contact. The plate is then exposed to a light source, a portion of which is composed of UV radiation. In the instance where a positive plate is used, the area on the film that corresponds to the image on the plate is opaque so that no light will strike the plate, whereas the area on the film that corresponds to the non-image area is clear and permits the transmission of light to the coating which then comes more soluble and is removed. In the case of a negative plate, the converse is true. The area on the film corresponding to the image area is clear while the non-image area is opaque. The coating under the clear area of film is hardened by the action of light while the area not struck by light is removed. The light-hardened surface of a negative plate is therefore oleophilic and will accept ink while the non-image area which has had the coating removed through the action of a developer is desensitized and is therefore hydrophilic.

One of the more serious problems which can afflict negative-working lithographic printing plates is inability of the developer to remove all residual coating from the non-image areas of the plate. When sufficient residual coating remains, a condition exists for background sensitivity to occur during the printing process. Minimally, the effect would be to increase the amount of water required in the fountain solution. Under more severe conditions, ink may adhere to the background and ultimately to the printed sheet, thereby resulting in a condition known as "tinting" or "toning." Under extremely severe conditions, there is so much ink in the background that it is referred to as "scumming." Thus it is apparent that the lithographic printing process requires a background surface which will accept and hold water well, in order to provide effective rejection of the lithographic printing ink.

While many kinds of water accepting lithographic printing supports have been made, there is a continuing need for economically prepared water accepting supports.

SUMMARY OF THE INVENTION

An object of this invention is to provide a thin layer on a support that is porous, durable, with high surface energy and with a high capacity for absorbing and holding water. This object is achieved by a method of making a porous, hydrophilic layer with a high surface energy on a substrate for a printing plate, ink jet receiver or the like comprising the steps of:

a) grinding an inorganic gel containing a liquid to provide a fine coatable dispersion of inorganic gel;

b) coating the dispersion of inorganic gel onto the substrate; and c) heating the dispersion coating to provide the porous hydrophilic layer.

ADVANTAGES

An advantage of this invention is that a hydrophilic layer with a high capacity of holding water can be prepared easily and economically.

Another advantage of the present invention is that the physical properties of the layer such as surface energy can be easily controlled and varied as desired.

Another advantage is that an apparatus that can deliver a reactive dispersed gel to a coating station with a minimum of hold time.

DETAILED DESCRIPTION OF THE INVENTION

Figure 1:
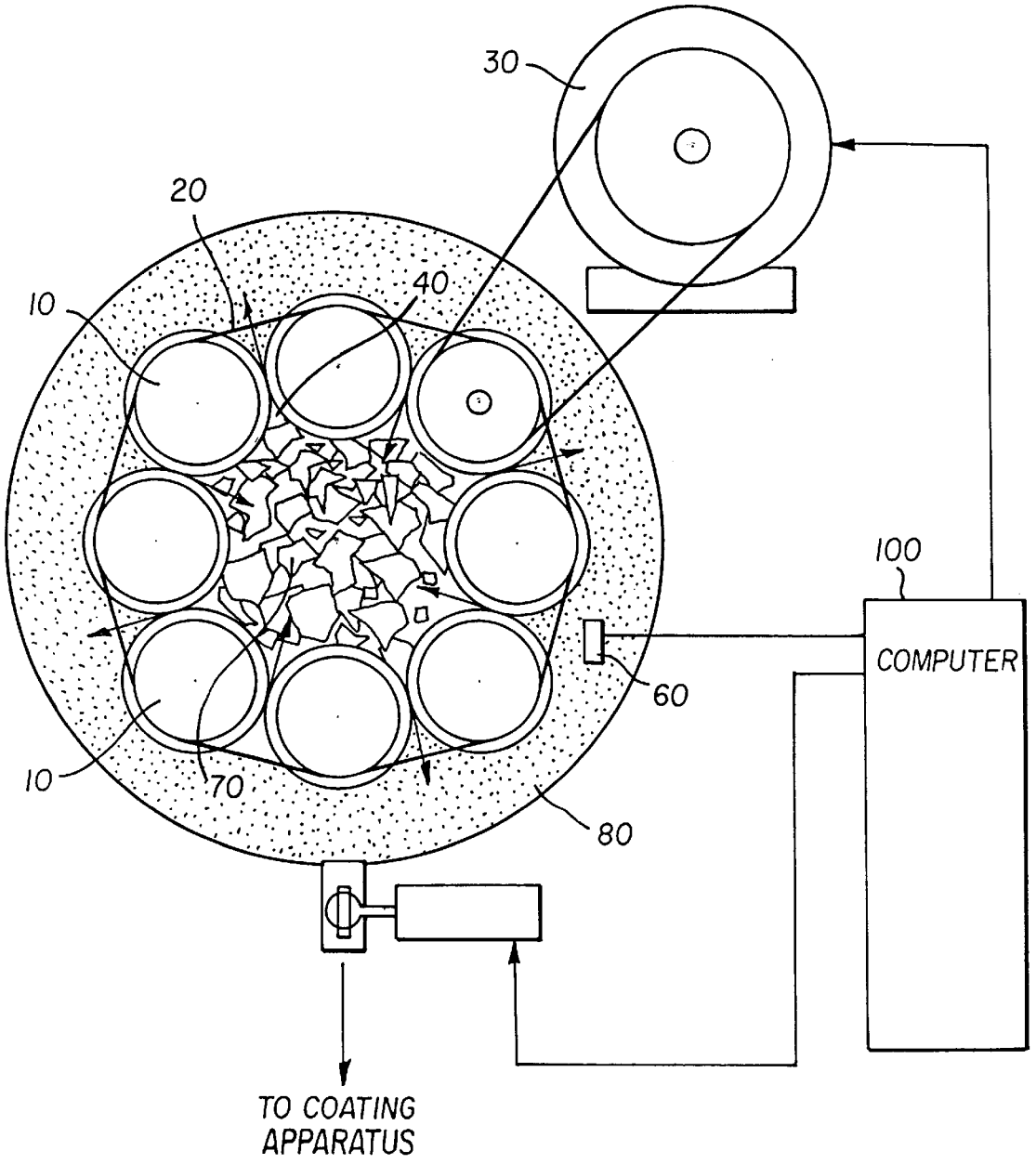
FIG. 1 shows a top view of an apparatus for fracturing and dispersing an inorganic gel.
Figure 2:
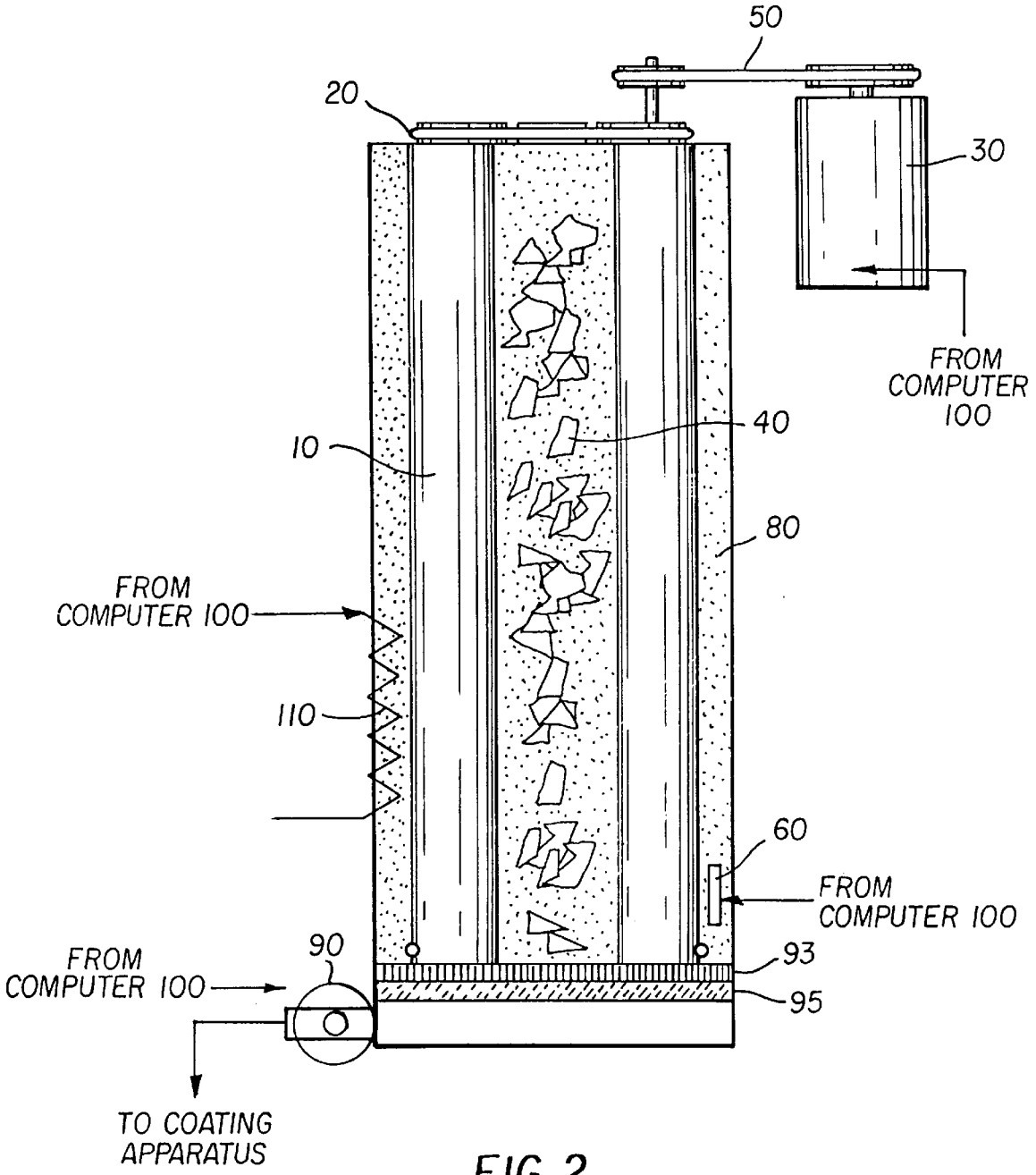
FIG. 2 shows a side view of the apparatus of FIG. 1.

Turning to FIG. 1, a top view is shown of an apparatus for fracturing and dispersing an inorganic gel. A gel receiving cavity is shown enclosing a set of opposed rollers 10 disposed around an entrance port 40. An O-ring belt 20 holds the rollers 10 in contact with each other. One of the rollers 10 is shown being driven by a drive belt 50 from a drive motor 30. The remaining rollers 10 are driven by contact with each other. As the rollers 10 turn, the inorganic gel 70 introduced at the entrance port passes between the rollers as shown by the arrows and is fractured and dispersed into a gel dispersion 80. Several passes into and out of the interior chamber are possible, until the desired degree of dispersion is measured by the sensor 60. When the desired degree of dispersion is obtained, the exit port 90 is opened and the dispersion can be pumped through a filter 95 supported by a screen 93 to a holding container, or directly to the coating station shown in FIG. 3. A computer 100 controls the drive motor 30, the sensor 60, the exit port 90 and the heater 110. The heater 110, which is not shown in FIG. 1, but is shown in FIG. 2, which is a side view of FIG. 1, can be used to control the temperature of the gel dispersion.

Figure 3:
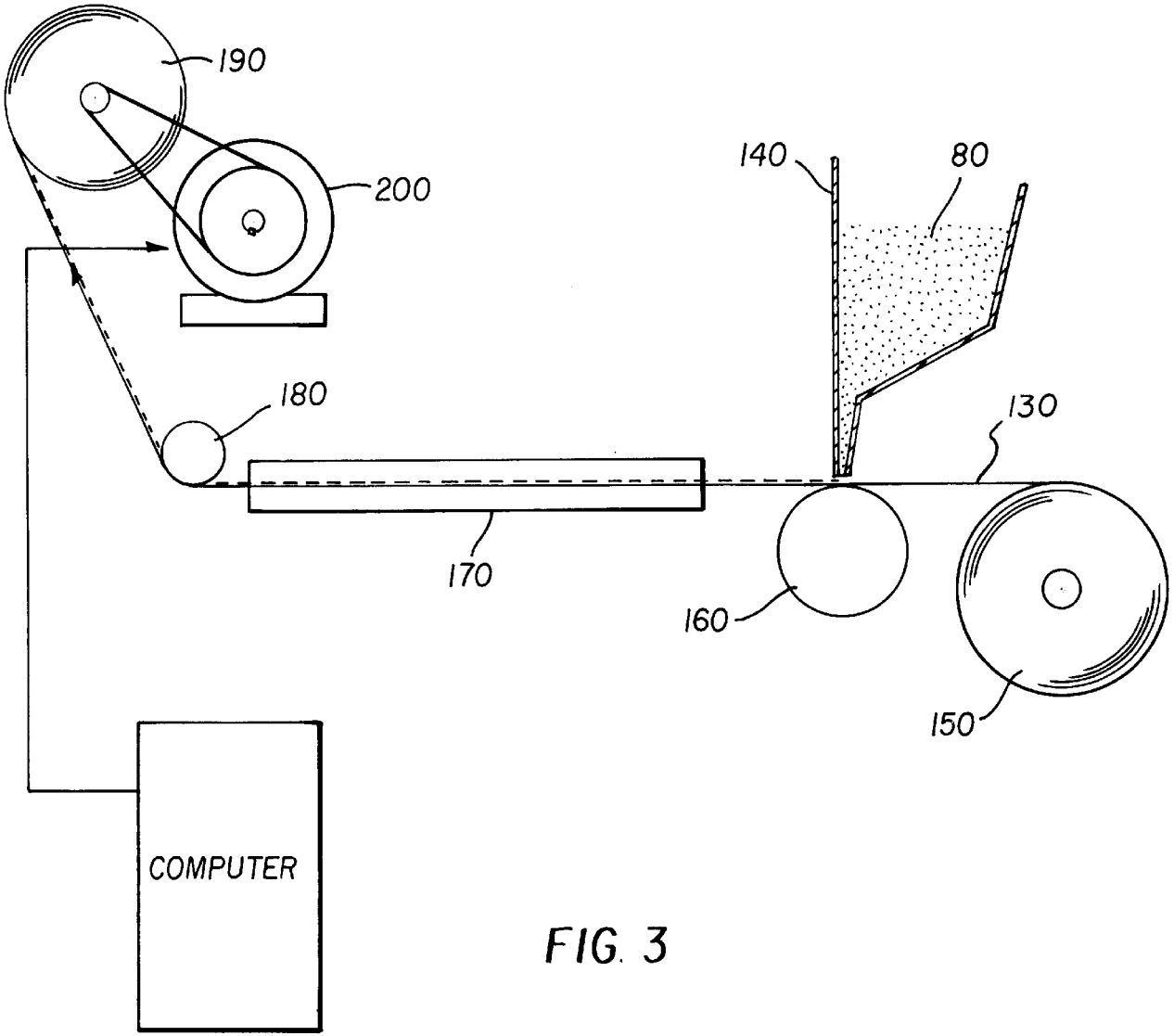
FIG. 3 shows a side view of the coating apparatus for coating the dispersion of inorganic gel of FIG. 1.

The coating station shown in FIG. 3 consists of a coating hopper 140 containing the gel dispersion 80. The coating hopper 140 meters the flow of the gel dispersion 80 onto the substrate web 130, which is conveyed from a supply roll 150 across a coating roller platen 160 through a dryer 170, around a transport roller 180 and to a take up roll 190, which is driven by a roller drive motor 200. The substrate web may be a web of paper, metal or polymer, depending on the final use of the coated web. For example, when used as a printing plate member where dimensional stability is important, an aluminum web may be chosen.

Other methods may also be used to disperse the inorganic gel, such as sonication, pumping the gel through a fine mesh, chopping with knives, tumbling with ball bearings or milling with sand. Dispersion may be done continuously, in line with the coating operation, or as a batch process, off line from the coating operation.

An inorganic xerogel is defined as a gel in which the liquid within the gel is removed by simple evaporation (Chemical Reviews, 1989, Vol. 89, No. 4, page 766). An inorganic gel is defined in the same reference as a colloidal system of solid character in which the dispersed substance forms a continuous, ramifying, coherent framework that is interpenetrated by a system (usually liquid) consisting of kinetic units smaller than colloidal entities. The common definition of a gelled liquid is very simple; when a liquid gels it will no longer pour.

The following is an example of the practice of the invention.

EXAMPLE 1

100 g of tetraethylorthosilicate were stirred with 500 ml each of water and ethanol and 0.15 g of concentrated hydrochloric acid was added. Stirring was continued until the mixture changed to one phase, about 3 minutes. The mixture was then held at 50° C. for three hours. Then 20 ml of 3-aminopropyltriethoxysilane was added with stirring until mixed. The mixture gelled within five minutes. The gel was allowed to sit for three hours and then broken into chunks about 1 cm in diameter. The chunks of gel were washed with a slow flow (about 100 ml per minute) of distilled water for 60 hours and then drained. The gel was then mixed with two parts of water by weight, and dispersed by first pushing the mixture through a sieve and then tumbling overnight with 1.8 mm diameter zirconium oxide beads. The slurry was then coated with a 40 micron meyer rod onto a support of 100 micron polyethyleneterephthalate which had been subbed with a subbing layer of poly (acrylonitrile-covinylidene chloride-co-acrylic acid) (14:79:7 weight ratio) and allowed to dry. The coating was then baked at 100° C. for three minutes. The result was a thin, porous layer that would accept and spread a 15 mg (15,000,000 picoliter) drop of water to a circle of about 8 mm diameter within one second. The layer was marked with a greasy marker and mounted on an ABDick press. The press was run for 500 impressions which had a very clean and clear white background, and then the fountain solution was turned off, and the plate printed all black. Then the fountain solution was turned back on and the plate background printed completely clear within 25 impressions. This press performance demonstrates the durability of the coating.

Although the reason for the durability is not completely understood, it may be supposed that there are unreacted sites in the xerogel that are exposed and consummate reactions to crosslink the matrix into an insoluble and durable whole. When inorganic gels are used wherein the exposed reaction sites have short lifetimes, the dispersion of the inorganic gel can be done in line to the coating station to minimize and hold time and thereby minimize unfruitful reaction of these sites to improve the durability of the final coated layer. The above example demonstrates both the high surface energy of the layer by the spreading of the water droplet on the surface and the high water holding capacity of the layer by the rapid clean up of the press surface when the fountain solution was re-activated during the press run.

A lithographic printing plate member can be made from the layer of this invention in several ways. In order for the porous hydrophilic layer of this invention to serve as a printing plate, a material must be provided on the surface of the hydrophilic layer to accept the lithographic printing ink. This material may be provided in a primitive kind of lithographic printing plate by writing on the surface with a grease pencil. The greasy written area will accept lithographic printing ink and the background will accept water and reject the lithographic printing ink. The layer can be coated with an overlayer of photosensitive polymer, such as is described in U.S. Pat. No. 4,743,530, issued May 10, 1988 to Samir Y. Farid et. al., and the plate can be imaged with a film mask to an ultraviolet light source, followed by development with a solvent which removes the unexposed photosensitive polymer. After development the areas of crosslinked photosensitive polymer will take lithographic ink on the printing press and the background will accept water and reject the lithographic printing ink. Another way to use the layer of this invention as a printing plate member is to write upon the surface with a special ink jet fluid as discussed in the above cross-referenced U.S. patent application Ser. No. 09/067,247 filed Apr. 27, 1998 in the name of Charles D. DeBoer et al. The materials which can be used include most common xerogels, which can be made by crosslinking reactions of a colloidal sol. A colloidal sol can be prepared by mechanically milling or grinding a material from a macroscopic to a microscopic state. Ultrasonic dispersion may also serve to break down larger aggregates of material, and sols have been produced by discharge between two electrodes made of the material in a solvent. However, the most favored method of making a sol-gel for the purposes of this patent application is by the chemical route of hydrolysis of an organometallic compound, as illustrated in the example cited above. Many kinds of inorganic xerogels can be used for the purposes of this patent application. The most favored are those derived from tri- and tetra-alkoxysilanes. However, xerogels derived from oxides of zirconium, titanium, aluminum, vanadium, tin, boron, beryllium, gadolinium, germanium, arsenic, indium, antimony, tellurium, lead, bismuth, magnesium, and the transition metals can also be used along with mixtures of the above.

The example described above demonstrates an offset lithographic printing plate member made by the method of this invention. An imaging member can also be made by the method of this invention. An example of this follows.

EXAMPLE 2

The layer of Example 1 was repeated, but the layer was not marked with a grease pencil. Instead the coated support was cut to 8.5×11 inches in size and inserted into an Epson Color Stylus 200 inkjet printer. A full color test page was printed onto the layer of this invention. There was some smearing of the black text where all three colored inks (cyan, magenta and yellow) are printed, but the single color magenta text letters were sharp and crisp. This demonstrates the utility of the layer of this invention as an imaging member.

The invention has been described in detail, with particular reference to certain preferred embodiments thereof, but it should be understood that variations and modifications can be effected with the spirit and scope of the invention.

PARTS LIST

| PARTS LIST | |
|---|---|
| 10 | rollers |
| 20 | O-ring belt |
| 30 | drive motor |
| 40 | entrance port |
| 50 | drive belt |
| 60 | sensor |
| 70 | inorganic |
| 80 | gel dispersion |
| 90 | exit port |
| 93 | screen |
| 95 | filter |
| 100 | computer |
| 110 | heater |
| 130 | substrate web |
| 140 | coating hopper |
| 150 | supply roll |
| 160 | coating roller platen |
| 170 | dryer |
| 180 | transport roller |
| 190 | take up roll |
| 200 | roller drive motor |

What is claimed is:

1. A method of making a porous, hydrophilic layer with a high surface energy on a substrate for a printing plate, ink jet receiver or the like comprising the steps of:

a) grinding an inorganic gel containing a liquid to provide a fine coatable dispersion of inorganic gel;

b) coating the dispersion of inorganic gel onto the substrate; and c) heating the dispersion coating to provide the porous hydrophilic layer.

2. A method of making a lithographic printing plate comprising the steps of:

a) grinding an inorganic gel containing a liquid to provide a fine coatable dispersion of inorganic gel;

b) coating the dispersion of inorganic gel onto the substrate;

c) heating the dispersion coating to provide a porous hydrophilic layer; and d) providing materials on the hydrophilic layer which accept lithographic printing ink.

3. The method of claim 2 wherein the materials are provided by ink jet printing a fluid which will accept lithographic printing ink.

4. The method of claim 3 wherein the fluid is a sol precursor and a liquid, and the liquid is removed to form, imagewise, an insoluble, crosslinked polymeric sol-gel matrix.

5. The method of claim 4 wherein said sol precursor is a di- or triether, or di- or triester of a metal oxide or mixture thereof, said metal oxide having at least one ink accepting non-ether or non-ester side chain that has up to 25% of its molecular weight being contributed by oxygen or nitrogen or sulfur atoms, or a mixture of the same, and the rest of its molecular weight being contributed by carbon and hydrogen atoms.

6. The method of claim 4 wherein said sol precursor is a 3-aminopropyltriethoxysilane.

* * * * *